US007448905B1

(12) United States Patent
Lin

(10) Patent No.: US 7,448,905 B1
(45) Date of Patent: Nov. 11, 2008

(54) RESCUE FLASH DRIVE

(76) Inventor: Hsiao-Chi Lin, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 11/882,076

(22) Filed: Jul. 30, 2007

(30) Foreign Application Priority Data

May 30, 2007 (TW) ..... 96208879 U

(51) Int. Cl.
*H01R 33/945* (2006.01)

(52) U.S. Cl. ..... 439/577; 206/537

(58) Field of Classification Search ..... 439/577, 439/528, 135; 206/537; 705/2, 3
See application file for complete search history.

(56) References Cited

U.S. PATENT DOCUMENTS 4,054,208 A * 10/1977 Lowe ..... 206/537
2005/0011803 A1* 1/2005 Chafoulias ..... 206/528
2006/0015368 A1* 1/2006 Hockey ..... 705/2
2006/0231109 A1* 10/2006 Howell et al. ..... 128/898
2007/0235350 A1* 10/2007 Warlick ..... 206/37
2008/0006556 A1* 1/2008 Bhuchar ..... 206/457
2008/0067082 A1* 3/2008 Huang ..... 206/1.5

* cited by examiner

*Primary Examiner*—Phuong K Dinh
(74) *Attorney, Agent, or Firm*—Troxell Law Office, PLLC

(57) ABSTRACT

A rescue flash drive, configured with a tubular main body, end surfaces of two ends of which are respectively concaved with a holding space. A circuit board main body at one end of a flash drive storage unit is positioned within one of the holding spaces, and a USB connector at another end of the flash drive storage unit protrudes outside the holding space. The flash drive storage unit prestores a number of pieces of health information on an individual. A cover covers the other holding space, thereby forming a sealed space, within which is deposited emergency medication. Accordingly, when an accident occurs, rescue workers can access the pieces of health information on the individual stored in the flash drive storage unit, at the same time use the emergency medication, thereby facilitating carrying out the most appropriate first aid and care in the shortest time.

6 Claims, 3 Drawing Sheets

RESCUE FLASH DRIVE

BACKGROUND OF THE INVENTION (a) Field of the Invention

The present invention relates to a rescue flash drive, and more particularly to a flash drive which stores a number of pieces of data on the health status (including medical history) of an individual and emergency first aid medication, thereby providing emergency first aid reference information and medication when administering first aid in a life-threatening emergency.

(b) Description of the Prior Art

Because excessively high risks are often taken when mountaineering or during other outdoor activities (rock climbing in particular), resulting in danger to self or others, thus, in order to prevent harm to life resulting from the danger, a whistle is normally carried that can be blown to call for help in an emergency and summon companions close by for first aid and care.

However, use of a whistle is only able to summon companions close by for first aid and care, and when companions arrive to rescue those in need, they have no way of knowing the health status and medical history (for example: heart disease, medication allergies, and so on) of those being rescued, or have simply not carried along appropriate emergency medication, and is thus difficult to determine what first aid and medication to administer, resulting in delaying first aid treatment. In particular, when those being rescued are injured, or when unconsciousness or unable to explain their personal health status (including medical history), then mistakes in diagnosis are very easily made and the wrong first aid administered.

SUMMARY OF THE INVENTION

Hence, in light of the shortcomings of the aforementioned prior art, the inventor of the present invention, having accumulated knowhow and manufacturing experience of various rescue products, attentively researched various methods to resolve such drawbacks, which following continuous research and improvements, culminated in the design of a completely new rescue flash drive of the present invention.

A primary objective of the present invention is to provide a rescue flash drive which stores a number of pieces of data on the health status of an individual and emergency first aid medication, thereby providing emergency first aid reference information and medication when administering first aid in a life-threatening emergency.

According to the aforementioned objective, the rescue flash drive of the present invention is configured with a tubular main body, end surfaces of two ends of which are respectively concaved with a holding space, wherein one of the holding spaces enables a flash drive storage unit to penetrate and be held therein, and which is covered with an outer cover. A circuit board main body at one end of the flash drive storage unit is positioned within one of the holding spaces, and a USB (Universal Serial Bus) connector at another end of the flash drive storage unit protrudes outside the holding space. The flash drive storage unit prestores a number of pieces of health information on an individual. A periphery of a cover is configured with an external screw thread, and an inner periphery of the other holding space of the main body is configured with a mutually matching internal screw thread, thereby enabling the external screw thread of the cover to screw into the internal screw thread of the holding space, thus joining the cover to the other end of the main body and enabling the other holding space to form a sealed space, within which is deposited emergency medication. Accordingly, when a life threatening emergency occurs, then rescue workers can access the pieces of data on the health status and medical history of the individual stored in the flash drive storage unit, and use the stored emergency medication, thereby enabling carrying out the most appropriate first aid and care.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
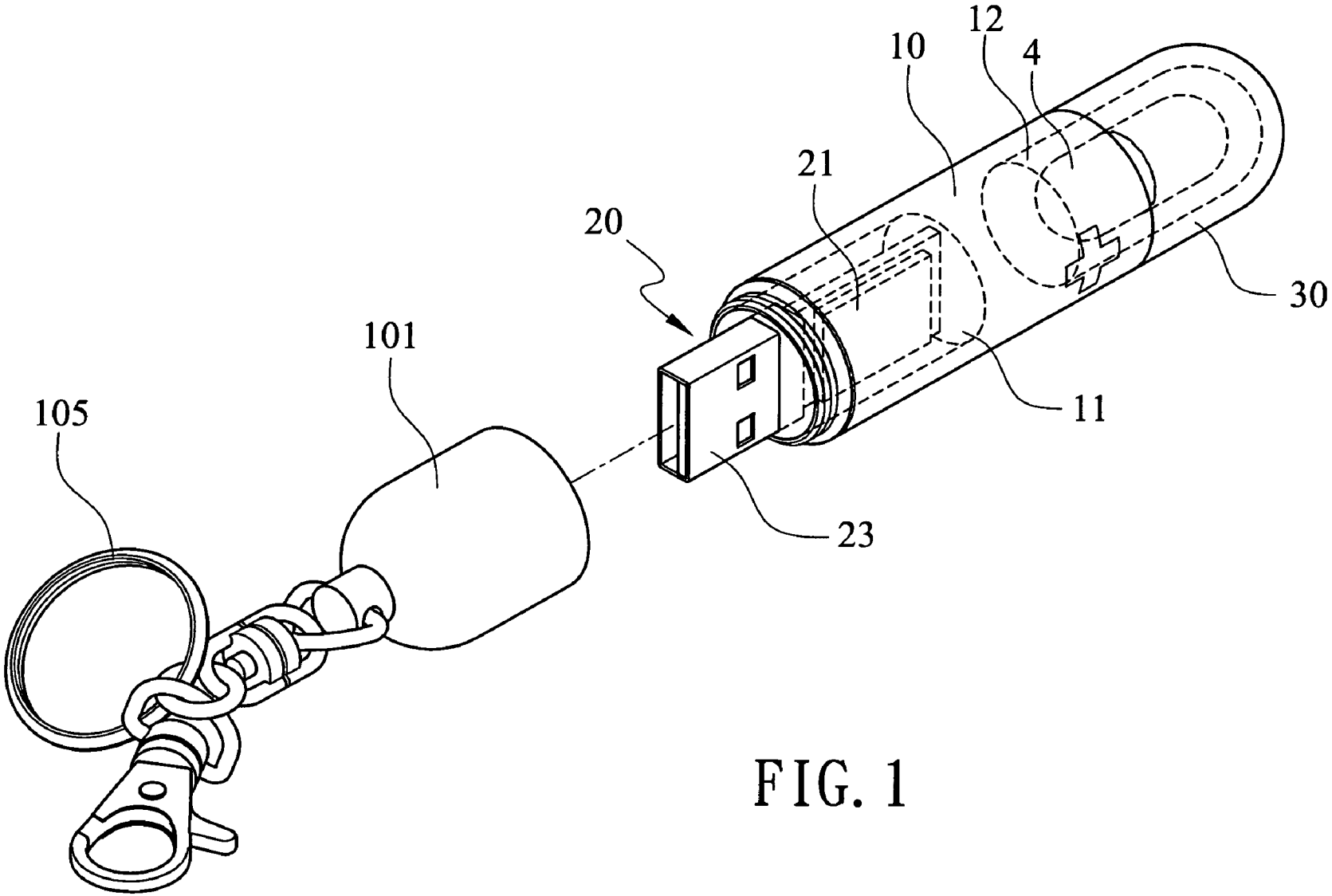
FIG. 1 shows an elevational external view of a rescue flash drive of the present invention.
Figure 2:
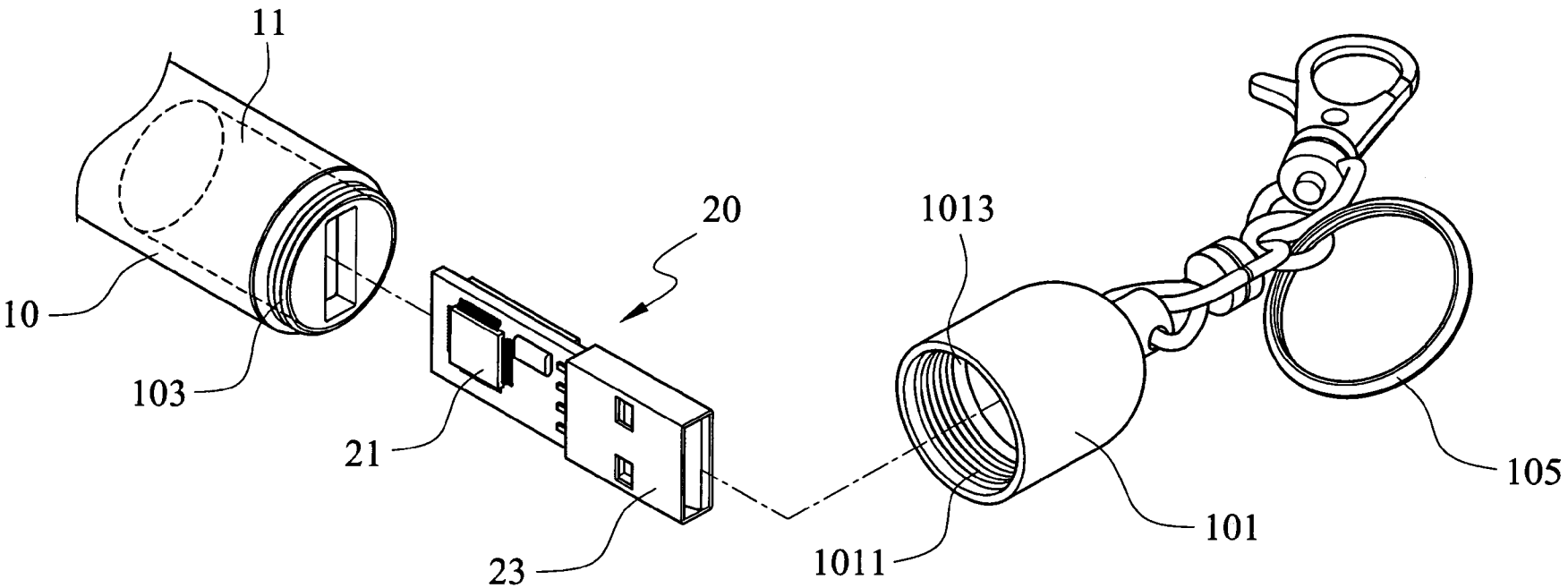
FIG. 2 shows a first structural schematic view of the rescue flash drive of the present invention.
Figure 3:
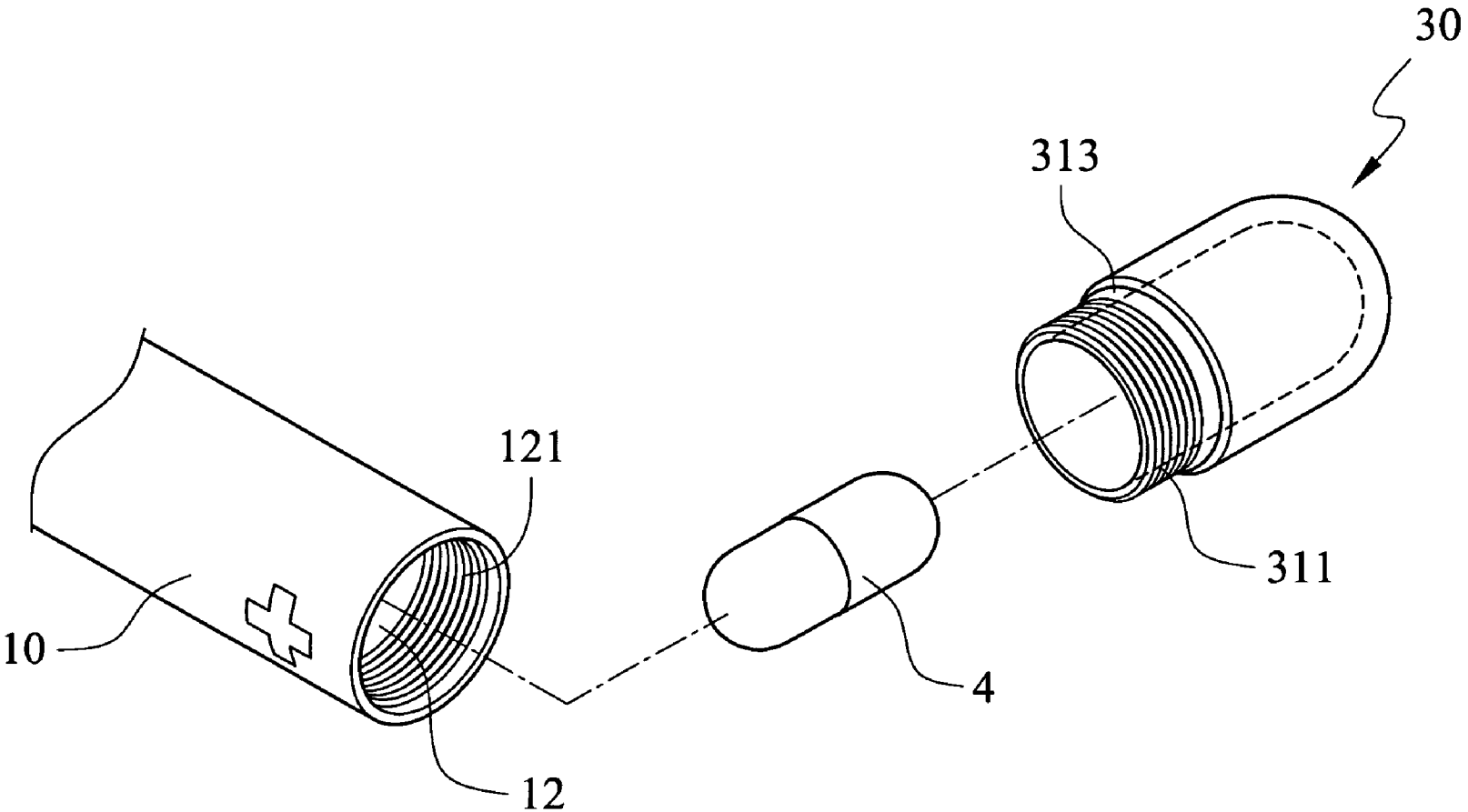
FIG. 3 shows a second structural schematic view of the rescue flash drive of the present invention.

Referring to FIGS. 1, 2 and 3, which show a rescue flash drive of the present invention, comprising a tubular main body 10, end surfaces of two ends of which are respectively concaved with holding spaces 11, 12, wherein the holding space 11 enables a flash drive storage unit 20 to penetrate and be held therein, and which is covered with an outer cover 101. A circuit board main body 21 at one end of the flash drive storage unit 20 is positioned within the holding space 11, and a USB (Universal Serial Bus) connector 23 at another end of the flash drive storage unit 20 protrudes outside the holding space 11. The flash drive storage unit 20 prestores a number of pieces of data, including health status and medical history (for example: heart disease, blood-group, medication allergies, and so on) on an individual.

A periphery of a cover 30 is configured with an external screw thread 311, and an inner periphery of the holding space 12 of the main body 10 is configured with a mutually matching internal screw thread 121, thereby enabling the external screw thread 311 of the cover 30 to screw into the internal screw thread 121 of the holding space 12, thus covering the other end of the main body 10 with the cover 30, and enabling the holding space 12 to form a sealed space, within which is deposited emergency medication 4.

According to the aforementioned assembly of component members, when a life threatening emergency occurs, rescue workers can use a computer to access the pieces of data stored in the flash drive storage unit 20 on the health status and medical history (for example: heart disease, blood-group, medication allergies, and so on) of the individual, and then use the emergency medication 4 within the cover 30, thereby facilitating carrying out the most appropriate first aid and care in the shortest time.

Referring again to FIGS. 1, 2 and 3, a watertight gasket 313 is mounted on the external screw thread 311 of the cover 30, thereby enabling providing a more tight seal when the cover 30 is screwed into the other holding space 12 of the main body 10, and providing a waterproof function.

Referring again to FIGS. 1, 2 and 3, an outer cover 101 is mounted on the flash drive storage unit 20 of the main body 10, which enables the outer cover 101 to cover the USB connector 23 of the flash drive storage unit 20, and thereby protect the USB connector 23. An inner periphery of the outer cover 101 is configured with an internal screw thread 1011, and a periphery of the main body 10 is configured with a matching external screw thread 103, thereby enabling the internal screw thread 1011 of the outer cover 101 to screw onto the external screw thread 103 of the main body 10, and thus cover the USB connector 23 of the flash drive storage unit 20 with the outer cover 101.

Referring again to FIGS. 1, 2 and 3, a watertight gasket 1013 is disposed within the outer cover 101, thereby enabling providing a more tight seal when the outer cover 101 is screwed onto the main body 10, and providing a waterproof function. In addition, a key ring 105 can be fitted to the outer cover 101, thereby facilitating portability and attachment of keys.

In conclusion, the rescue flash drive of the present invention is assuredly provided with an Innovative structure not found in prior art. Moreover, products having a similar structure to that of the present invention have not been seen in any publication or in the market, the present invention is thus provided with undoubted originality. In addition, the present invention is provided with unique characteristics and functionality that are without comparison in prior art. Hence, the incomparable advancement of the present invention clearly complies with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A rescue flash drive, comprising:

a tubular main body, end surfaces of two ends of which are respectively concaved with a holding space;

a flash drive storage unit, a circuit board main body located at one end of which is positioned within one of the holding spaces, and a USB (Universal Serial Bus) connector at another end of the circuit board main body protrudes outside the holding space; the flash drive storage unit prestores a number of pieces of data on the health status and medical history of an individual; and a cover, a periphery of which is configured with an external screw thread, and an inner periphery of the other holding space of the main body is configured with a mutually matching internal screw thread, thereby enabling the external screw thread of the cover to screw into the internal screw thread of the holding space, thus joining the cover to the other end of the main body and enabling the holding space to form a sealed space, within which is deposited emergency medication.

2. The rescue flash drive according to claim 1, wherein a watertight gasket is mounted on the external screw thread of the cover, thereby providing a more tight seal when the cover is screwed into the other holding space of the main body, and providing a waterproof function.

3. The rescue flash drive according to claim 1, wherein an outer cover is mounted on the flash drive storage unit of the main body, which enables the outer cover to cover the USB connector of the flash drive storage unit, and thereby protect the USB connector.

4. The rescue flash drive according to claim 3, wherein an inner periphery of the outer cover is configured with an internal screw thread, and a periphery of the main body is configured with a matching external screw thread, thereby enabling the internal screw thread of the outer cover to screw onto the external screw thread of the main body, and thus cover the USB connector of the flash drive storage unit with the outer cover.

5. The rescue flash drive according to claim 4, wherein a watertight gasket is disposed within the outer cover, thereby providing a more tight seal when the outer cover is screwed onto the main body, and providing a waterproof function.

6. The rescue flash drive according to claim 5, wherein a key ring is fitted to the outer cover.

* * * * *